US008534387B2

(12) United States Patent
Taraldrud

(10) Patent No.: US 8,534,387 B2
(45) Date of Patent: Sep. 17, 2013

(54) DRAWWORKS DEVICE ON A DRILL FLOOR

(75) Inventor: Paal Taraldrud, Hamresanden (NO)

(73) Assignee: National Oilwell Norway AS (NO)

( * ) Notice: Subject to any disclaimer, the term of this patent is extended or adjusted under 35 U.S.C. 154(b) by 667 days.

(21) Appl. No.: 12/308,591

(22) PCT Filed: Jun. 7, 2007

(86) PCT No.: PCT/NO2007/000195

§ 371 (c)(1),
(2), (4) Date: Aug. 11, 2010

(87) PCT Pub. No.: WO2007/148977

PCT Pub. Date: Dec. 27, 2007

(65) Prior Publication Data

US 2010/0294568 A1 Nov. 25, 2010

(30) Foreign Application Priority Data

Jun. 19, 2006 (NO) ..... 20062853

(51) Int. Cl.
*E21B 19/02* (2006.01)
*E21B 19/08* (2006.01)

(52) U.S. Cl.
USPC ..... 175/203; 166/77.1; 166/75.14

(58) Field of Classification Search
USPC ..... 166/381, 77.1, 75.14; 175/162, 175/203; 414/22.63; 254/388–390, 393–397
See application file for complete search history.

(56) References Cited

U.S. PATENT DOCUMENTS

| | | | | |
|---|---|---|---|---|
| 3,513,996 A | | 5/1970 | Woolslayer et al. | 414/22 |
| 3,658,298 A | * | 4/1972 | Moore et al. | 254/286 |
| 3,936,034 A | | 2/1976 | Larralde | |
| 4,449,596 A | | 5/1984 | Boyadjieff | 175/85 |
| 4,458,768 A | | 7/1984 | Boyadjieff | 175/85 |
| 4,553,590 A | * | 11/1985 | Phillips | 166/53 |
| 4,765,401 A | | 8/1988 | Boyadjieff | 166/77.5 |
| 5,437,527 A | | 8/1995 | McGill et al. | 414/51 |

FOREIGN PATENT DOCUMENTS

EP 0162001 4/1985

OTHER PUBLICATIONS

Canadian Application S/N 2,654,932 Office Action dated Jul. 12, 2011.

* cited by examiner

*Primary Examiner* — Shane Bomar
*Assistant Examiner* — Catherine Loikith
(74) *Attorney, Agent, or Firm* — Conley Rose, P.C.

(57) ABSTRACT

A drawworks device on a drill floor includes an upper pulley assembly connected to a heave-compensated or fixed mounting. In addition, the drawworks device includes a main block connected to a pipe mount. The pipe mount is laterally movable in at least one direction relative to the drilling center of the drill floor. The pulley assembly is pivotal about a horizontal first axis oriented perpendicular to the direction of lateral movement of the pipe mount.

16 Claims, 4 Drawing Sheets

DRAWWORKS DEVICE ON A DRILL FLOOR

CROSS REFERENCE TO RELATED APPLICATIONS

This application claims the benefits of priority under the Patent Laws of the United States of Norway Application Number 20062853 filed Jun. 19, 2006; and International Application Number PCT/NO2007/000195 filed Jun. 7, 2007 published as International Publication Number WO 2007/148977 A1 on Dec. 27, 2007—all of which applications and publication are incorporated fully herein for all purposes.

BACKGROUND OF THE INVENTION

1. Field of the Invention

This invention relates to a drawworks. More particularly it relates to a drawworks on a drill floor, the drawworks including an upper pulley assembly connected to a heave-compensated or fixed mounting, and a main block connected to a pipe mount which is laterally movable relative to the drilling centre of the drill floor in at least one direction, the pulley assembly being rotatable about a horizontal first axis perpendicular to the direction of lateral movement.

2. Description of Related Art

A main block belonging to a drawworks on a drill floor is often connected to a drilling machine (top drive) which is arranged to be connectable to a drill string, for example, and which is movable along a vertical rail.

To facilitate the joining or removal of, for example, pipe lengths into/from a drill string, it is also usual for the drilling machine to be laterally movable relative to the drilling centre of the drill floor.

In earlier constructions the pulley axes of the upper pulley assembly and main block were oriented perpendicularly to the direction of lateral movement. Thereby there was no oblique pull on the wire of the drawworks even if the main block was moved sideways.

However, experience went to show that the main block, which is of considerable dimensions, was obstructive to the work on the drill floor when oriented with the pulley axis in said direction. In more recent drawworks the pulley axis of the main block is in the same plane as the direction of lateral movement, whereby the main block takes a position which is, to a considerably degree, less obstructive to the work on the drill floor.

However, when, in its position laterally offset, the main block is hoisted towards its upper position, there is in this more recent construction an unfavourable wire angle between the hoisting wire and the wire pulleys of the upper pulley assembly. This unfavourable wire angle leads to unnecessarily great wear to the pulleys of the upper pulley assembly and to the wire.

BRIEF SUMMARY OF THE INVENTION

The invention has for its object to remedy or reduce at least one of the drawbacks of the prior art.

The object is achieved in accordance with the invention through the features, which are specified in the description below and in the claims that follow.

A drill floor drawworks in accordance with the invention, the drawworks including an upper pulley assembly which is connected to a heave-compensated or fixed mounting, and a main block which is connected to a pipe mount which is laterally movable relative to the drilling centre of the drill floor in at least one direction, is characterized by the pulley assembly being rotatable about a horizontal first axis perpendicular to the direction of lateral movement.

The main block is typically rotatable about a second axis, which is parallel to the first axis, the pipe mount normally including a drilling machine. The heave-compensated or fixed mounting may be formed by a crown beam. The first axis, about which the pulley assembly rotates, may be provided by means of a hinged adapter, which is connected between the crown beam and the pulley assembly.

The device according to the invention provides a solution to a technically challenging and costly weakness of prior art drawworks.

BRIEF DESCRIPTION OF THE SEVERAL VIEWS OF THE DRAWINGS

In what follows is described a non-limiting example of a preferred embodiment which is visualized in the accompanying drawings, in which.

DETAILED DESCRIPTION OF THE INVENTION

Figure 1:
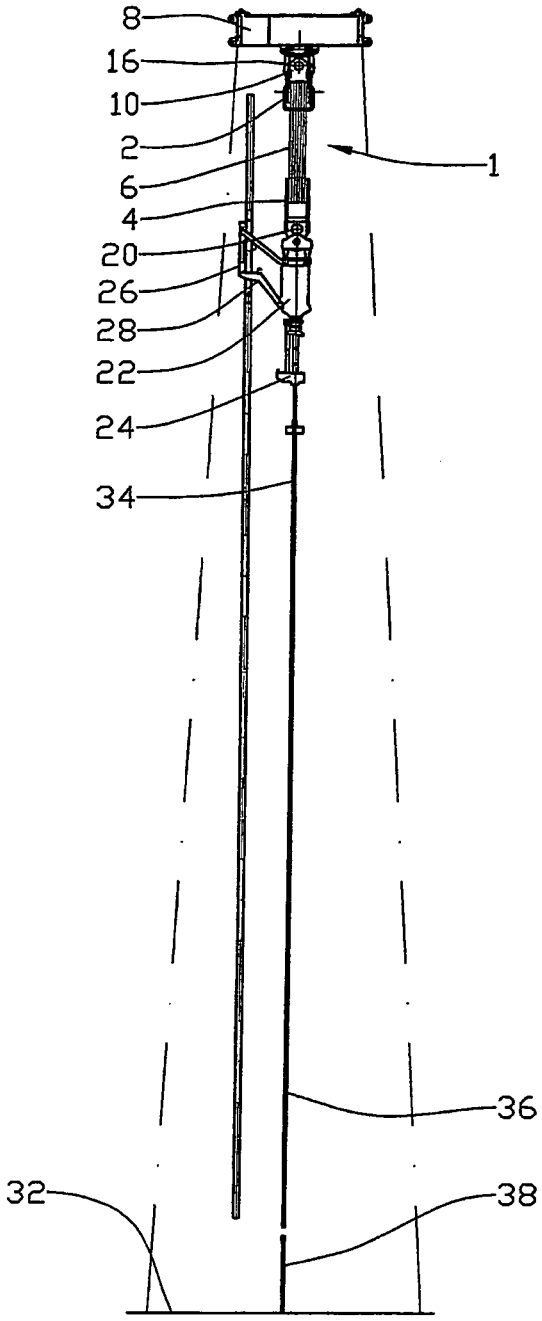
FIG. 1 shows a drawworks according to the invention together with some adjacent components, a pipe length hanging from the drawworks above a drill floor.

In the drawings the reference numeral 1 indicates a drawworks including, apart from a winch not shown, an upper pulley assembly 2, a main block 4 and a hoisting wire 6.

The upper pulley assembly 2 rotates about a rotational axis 18 to raise and lower the main block 4 via the hoisting wire 6, and is connected to a mounting 8 in the form of a crown beam by means of a hinged adapter 10.

Figure 4:
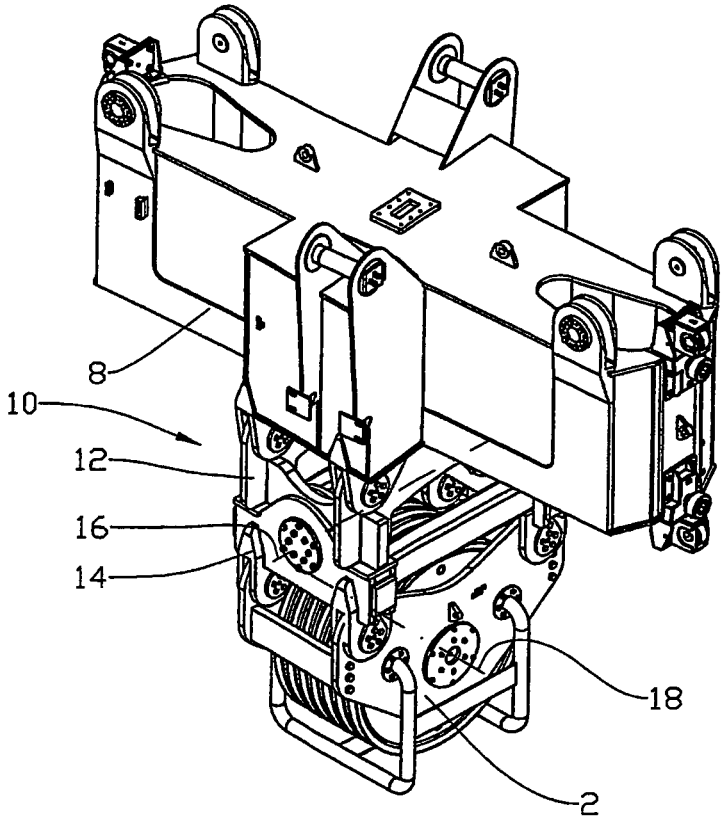
FIG. 4 shows, on a further enlarged scale and in perspective, a detailed view of the mounting of an upper pulley assembly to a crown beam.

The hinged adapter 10 includes an upper portion 12 which is connected to the crown beam 8, and a lower portion 14 which is connected to the pulley assembly, see FIG. 4, the upper portion 12 and the lower portion 14 hinging relative to each other about a first axis 16.

The first axis 16 is approximately perpendicular to the direction of lateral movement of the main block 4.

The main block 4 is connected about a second axis 20 to a drilling machine 22 including a pipe mount 24. The second axis 20 is parallel to the first axis 16.

The drilling machine 22 is connected, in a manner known per se, to a carriage 26 by means of pivotal arms 28. The carriage 26 is movable along a vertical rail 30.

Figure 3:
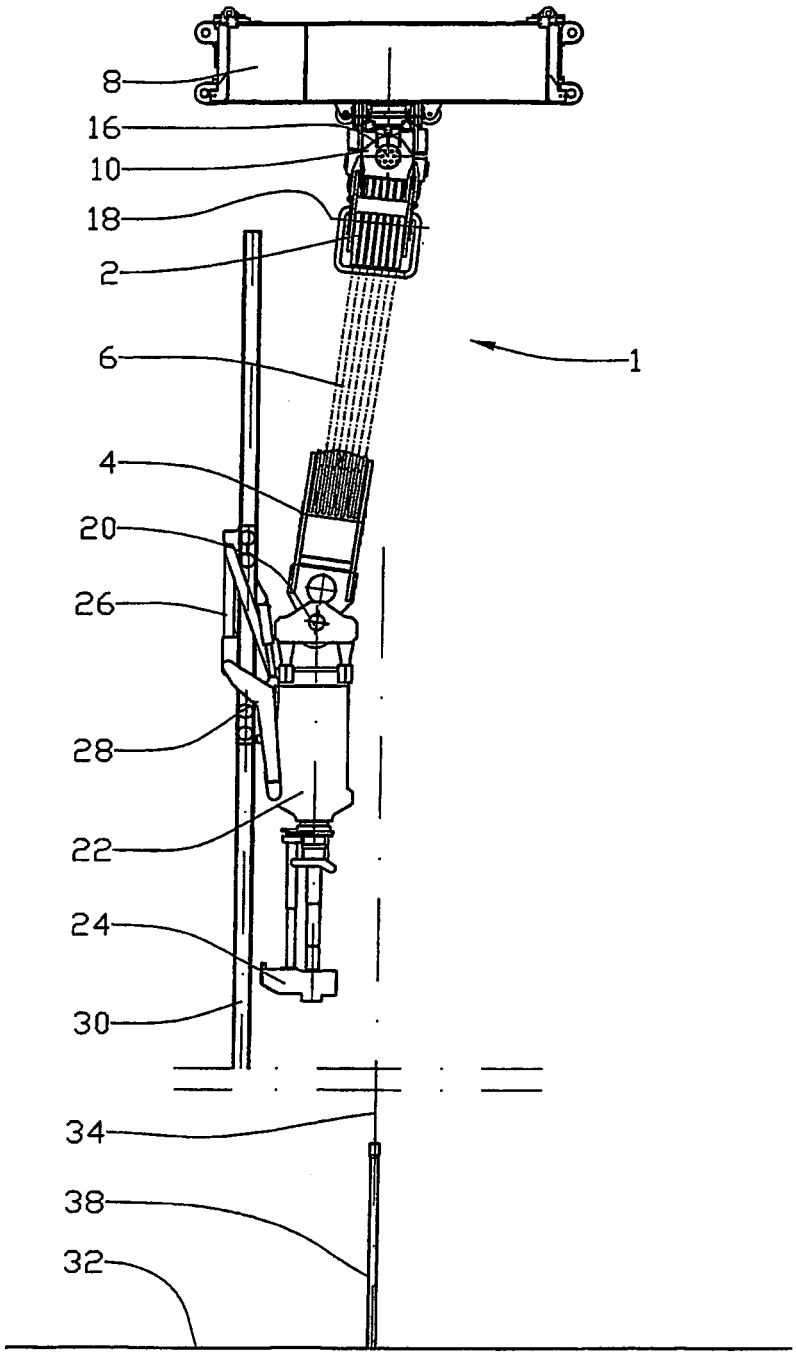
FIG. 3 shows, on a larger scale, a section of the draw-works of FIG. 1.

The pivotal arms 28 are arranged to move the drilling machine 22 and thereby the pipe mount 24 between the drilling centre 34 of a drill floor 32, see FIG. 1, and a position laterally offset, see FIG. 3, from which a pipe 36 for example, see FIG. 1, can be moved in to the drilling centre 34 to be connected to a drill string 38 projecting from the drill floor, without the drilling machine 22 obstructing the operation.

Figure 2:
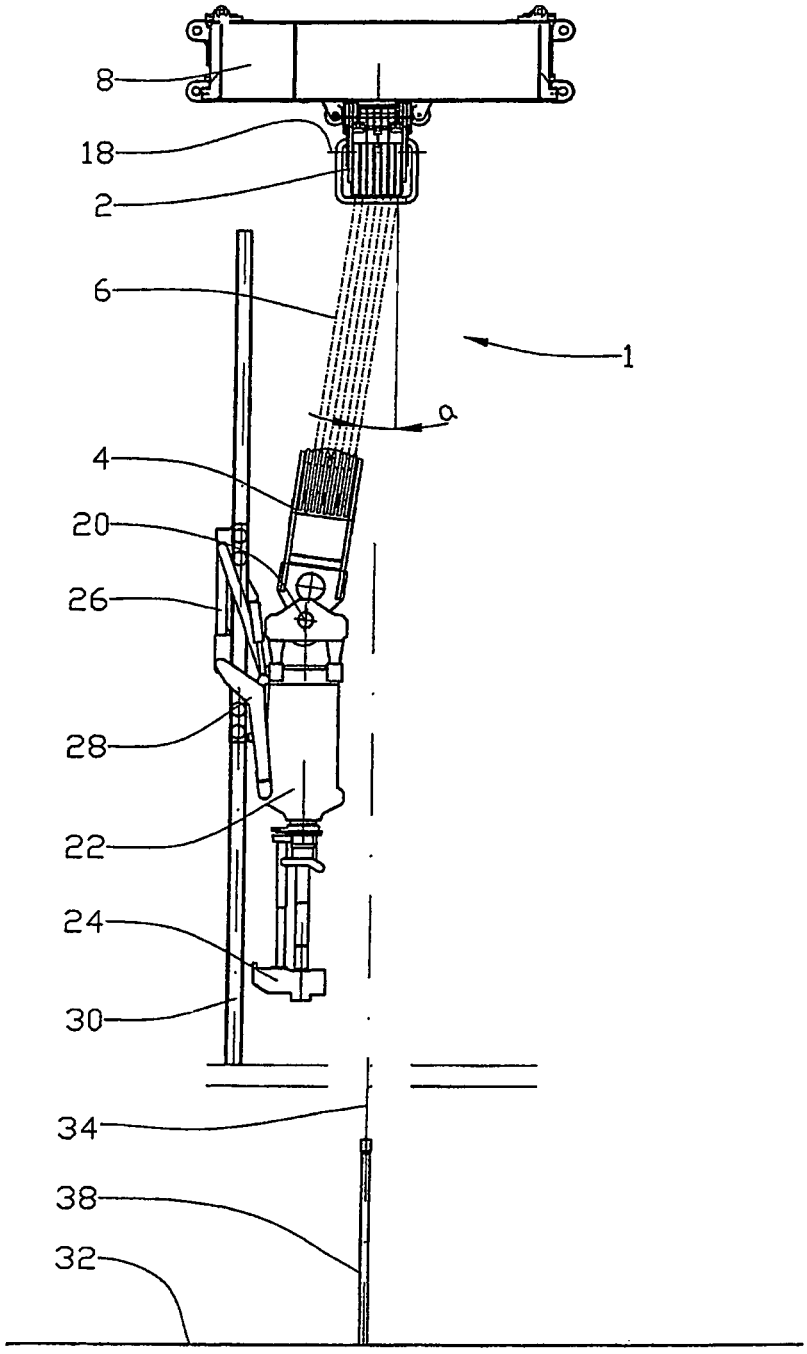
Fig. 2 Prior Art
FIG. 2 shows, on a larger scale, a prior art drawworks.

When the hoisting wire 6 moves the carriage 26 together with the drilling machine 22 and the pipe mount 24 in the position laterally offset upwards along the rail 30, the upper pulley assembly 2 will pivot about the first axis 16 so that an oblique angle "a" between the hoisting wire 6 and the pulley assembly 2, see FIG. 2, created in prior art equipment, is reduced to a substantial degree.

What is claimed is:

1. A drawworks apparatus on a drill floor, the drawworks device comprising:

an upper pulley assembly configured to rotate about a rotational axis;

a hinged adapter pivotally coupling the pulley assembly to a crown beam, wherein the hinged adapter includes an upper portion connected to the crown beam and a lower portion hingedly connected to the upper portion, wherein the lower portion is configured to pivot relative to the upper portion about a first horizontal axis and the upper pulley assembly is rotatably connected to the lower portion; and a main block suspended from the pulley assembly with a hoisting wire, wherein the pulley assembly is configured to raise and lower the main block by rotating about the rotational axis;

wherein the main block is configured to move laterally relative to a drill string projecting upward from the drill floor;

wherein the first axis is oriented perpendicular to the direction of lateral movement of the main block;

wherein the rotational axis of the pulley assembly is oriented approximately parallel to the direction of lateral movement of the main block.

2. The drawworks apparatus of claim 1 further comprising a drilling machine connected to the main block, wherein the drilling machine is configured to pivot relative to the main block about a second axis oriented parallel to the first axis.

3. A drawworks apparatus for supporting a drilling machine above a drill floor, the drawworks apparatus comprising:

a crown beam;

a hinged adapter including an upper portion connected to the crown beam and a lower portion pivotally connected to the upper portion, wherein the lower portion is configured to pivot relative to the upper portion about a first horizontal axis;

a pulley assembly rotatably coupled to the lower portion of the hinged adapter, wherein the pulley assembly includes a hoisting wire; and a main block suspended from the pulley assembly by the hoisting wire.

4. The drawworks apparatus of claim 3 further comprising a drilling machine connected to the main block.

5. The drawworks apparatus of claim 4 wherein the drilling machine is pivotably connected to the main block.

6. The drawworks apparatus of claim 5 further comprising a rail, a carriage connected and movable on the rail, the drilling machine pivotably connected to the carriage.

7. The drawworks apparatus of claim 6 further comprising a pipe mount connected to the drilling machine.

8. The drawworks apparatus of claim 6 wherein the drill floor has a drilling center and wherein the drilling machine is movable with the carriage between the drilling center of the drill floor and a position laterally offset therefrom.

9. The drawworks apparatus of claim 8 wherein, upon upward movement of the drilling machine, an angle between the hoisting wire and a line through the drilling center is reduced by pivoting of the main block with respect to the crown beam.

10. A drawworks apparatus for supporting a drilling machine above a drill floor, the drill floor having a drilling center, the drawworks apparatus comprising:

a crown beam;

a pulley assembly hingedly connected with a hinged adapter to the crown beam, the pulley assembly including a hoisting wire;

a main block suspended from the pulley assembly by the hoisting wire a drilling machine pivotably connected to the main block a rail;

a carriage connected and movable on the rail;

wherein the drilling machine is pivotably connected to the carriage, the drilling machine movable with the carriage between the drilling center of the drill floor and a position laterally offset therefrom;

wherein, upon upward movement of the drilling machine, an angle between the hoisting wire and a line through the drilling center is reduced by pivoting of the main block with respect to the crown beam;

wherein the hinged adapter includes an upper portion connected to the crown beam and a lower portion hingedly connected to the upper portion about a horizontal first axis, the main block movable in a first direction laterally, the first axis approximately perpendicular to the first direction, the drilling machine connected to the main block about a second axis, and the second axis parallel to the first axis.

11. A method for moving a drilling machine above a drill floor, the method comprising:

connecting a drilling machine to a main block of a drawworks apparatus, the drawworks apparatus comprising a crown beam, a pulley assembly hingedly connected to the crown beam and including a hoisting wire, and the main block suspended from the pulley assembly by the hoisting wire;

pivoting the pulley assembly relative to the crown beam about a horizontal first axis with a hinged adapter; and raising or lowering the drilling machine with respect to the drill floor using the drawworks apparatus.

12. The method of claim 11 wherein the drilling machine is pivotably connected to the main block and the drawworks apparatus further comprises a rail, a carriage connected and movable on the rail, the drilling machine pivotably connected to the carriage, wherein the drill floor has a drilling center and wherein the drilling machine is movable with the carriage between the drilling center of the drill floor and a position laterally offset therefrom, the method further comprising moving the drilling machine between the drilling center and the position laterally offset therefrom.

13. The method of claim 12 wherein, upon upward movement of the drilling machine, an angle between the hoisting wire and a line through the drilling center is reduced by pivoting of the main block with respect to the crown beam.

14. The method of claim 11 wherein a hinged adapter hingedly connects the pulley assembly to the crown beam, and wherein the hinged adapter includes an upper portion connected to the crown beam and a lower portion hingedly connected to the upper portion about the first axis the axis.

15. The method of claim 14 wherein the main block is movable in a first direction laterally, and wherein the first axis is approximately perpendicular to the first direction, the method further comprising moving the main block in the first direction laterally.

16. The method of claim 14 wherein the drilling machine is connected to the main block and configured to pivot relative to the main block about a second axis, the second axis parallel to the first axis.

* * * * *

UNITED STATES PATENT AND TRADEMARK OFFICE

CERTIFICATE OF CORRECTION

PATENT NO. : 8,534,387 B2
APPLICATION NO. : 12/308591
DATED : September 17, 2013
INVENTOR(S) : Paal Taraldrud It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1267 days.

Signed and Sealed this
Fifteenth Day of September, 2015

Michelle K. Lee

Michelle K. Lee
*Director of the United States Patent and Trademark Office*